United States Patent [19]

Nagano

[11] 4,308,496

[45] Dec. 29, 1981

[54] REFERENCE CURRENT SOURCE CIRCUIT

[75] Inventor: Katsumi Nagano, Hiratsuka, Japan

[73] Assignee: Tokyo Shibaura Denki Kabushiki Kaisha, Japan

[21] Appl. No.: 169,153

[22] Filed: Jul. 15, 1980

[30] Foreign Application Priority Data

Aug. 9, 1979 [JP] Japan ..... 54-100764

[51] Int. Cl.[3] ..... G05F 3/20

[52] U.S. Cl. ..... 323/315

[58] Field of Search ..... 323/312-315, 323/316; 330/296, 297

[56] References Cited

U.S. PATENT DOCUMENTS 4,234,841 11/1980 Schade, Jr. ..... 323/316 X

FOREIGN PATENT DOCUMENTS 2517174 10/1976 Fed. Rep. of Germany ..... 323/315

OTHER PUBLICATIONS

"Integrated Linear Basic Circuits", Th. J. van Kessel & R. J. van de Plassche, *Philip Technical Review*, vol. 32, No. 1, pp. 1-12, 1971.

"An Accurate Integrated Voltage-To-Current Converter", A. T. van Zanten & J. H. Huijsing, *IEEE Journal of Solid State Circuits*, vol. SC-10, No. 6, pp. 432-436, 1975.

*Primary Examiner*—William M. Shoop

*Attorney, Agent, or Firm*—Finnegan, Henderson, Farabow, Garrett & Dunner

[57] ABSTRACT

A reference current source circuit comprises a current sink including a pair of transistors having different emitter areas and an emitter resistor connected to the emitter of one of the transistors having greater emitter area, and producing sink currents of the same magnitude which is dependent on the emitter area ratio and the resistance value of the emitter resistor and independent of a supply voltage. In order to supply the current sink with the sink currents, there are used two constant current sources to produce constant source currents of the same magnitude greater than that of the sink currents and a current mirror connected to these constant current sources. The current mirror absorbs surplus currents of a magnitude equal to the difference between the magnitudes of the source current and sink current.

5 Claims, 16 Drawing Figures

REFERENCE CURRENT SOURCE CIRCUIT

BACKGROUND OF THE INVENTION

This invention relates to a reference current source circuit.

There is conventionally known an integrated reference current source circuit which comprises a first current source (current sink) including first and second NPN-type transistors having different emitter areas and bases connected with each other, one of the transistors being diode-connected, and a resistor connected to the emitter of one of the transistors having a greater emitter area, so that the currents (the collector currents of the first and second transistors) of the same magnitude which is dependent on the emitter area ratio between the first and second transistors and the resistance value of the resistor are caused to flow into the first current source, a second current source or current mirror using PNP-type transistors, whereby the collector currents of the first and second transistors of the same magnitude are allowed to flow into the first current source, and an NPN-type output transistor driven by the first current source to provide an output current. For this circuit, refer to FIG. 10 on page 7 of a paper entitled "Integrated linear basic circuits" (Th. J. van Kessel and R. J. van de Plassche, Philips Technical Review, Vol. 32, 1971, No. 1, pp. 1–12).

The aforesaid output transistor is connected with the diode-connected transistor of the first current source in current-mirror configuration. If the diode-connected transistor and output transistor have the same emitter area, the output current $I_0$ is equivalent to the collector currents of the first and second transistors, and is given by $$I_0 = \frac{V_T}{R} \cdot \ln N$$

where $V_T$ is the volt-equivalent of temperature, R is the resistance value of the emitter resistor, and N is the ratio between the emitter areas of the first and second transistors. Evidently, the output current $I_0$ is independent of supply voltage and is proportional to temperature.

In this prior art reference current source circuit, a current mirror comprised of PNP transistors is used as the second current source in order that the sink currents of the same magnitude are produced by the first current source. As is generally known, a PNP transistor has smaller $\beta$ (common-emitter current gain) than an NPN transistor, so that base current of the PNP transistor cannot be ignored. As compared with an NPN-transistor current mirror, therefore, the PNP-transistor current mirror is subject to greater error, with respect to the ideal value "1", in the ratio between the magnitudes of two currents flowing through the current mirror. Due to such error, the output current is also subject to an error with respect to a desired value. Where a Wilson source comprised of three PNP transistors is used as a current mirror, as shown in FIG. 10 in the aforementioned paper, the current ratio of the current mirror further approaches 1, though it still is subject to the influence of $\beta$. Owing to the temperature-dependence of $\beta$ of PNP transistors, moreover, the current ratio of the current mirror is liable to change with temperature. Thus, with use of a current mirror including PNP transistors, it is relatively difficult to allow two currents of the same magnitude dependent on the emitter area ratio between the first and second transistors and the emitter resistor to flow into the first current source. In the aforementioned circuit, furthermore, there is required a start-up circuit for actuating the circuit when a power is applied to the circuit.

SUMMARY OF THE INVENTION

An object of this invention is to provide a reference current source capable of more easily supplying a current sink with two sink currents of the same magnitude which is dependent on the emitter area ratio and emitter resistance, as compared with the aforementioned prior art current source circuit, and requiring no start-up circuit.

In order to supply the current sink with two sink currents of the same magnitude dependent on the current sink, according to this invention, there are used two current sources to produce source currents of the same magnitude greater than that of the sink currents and a current mirror connected to the current sources to absorb currents of a magnitude equivalent to the difference between the magnitudes of the source current and sink current.

DETAILED DESCRIPTION OF THE PREFERRED EMBODIMENT

Figure 1:
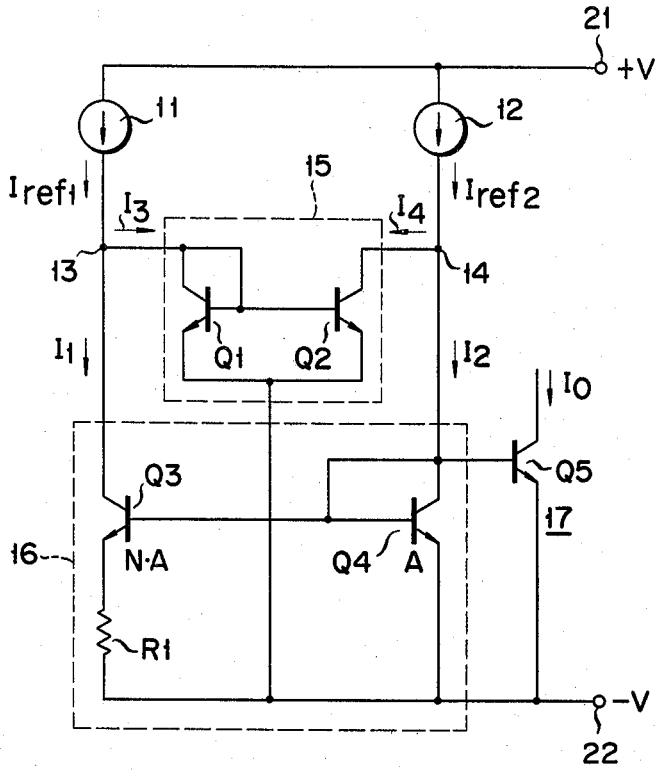
FIG. 1 shows a reference current source circuit embodying this invention.

Referring now to FIG. 1 showing a reference current source circuit embodying this invention, reference numerals 11 and 12 designate constant current sources connected to a positive power supply terminal 21 for producing constant source currents $I_{ref1}$ and $I_{ref2}$ of the same magnitude, respectively. Outputs 13 and 14 of the constant current sources 11 and 12 are connected with a current mirror 15 which is formed of NPN transistors Q1 and Q2. The transistors Q1 and Q2 have their emitters connected in common to a negative power supply terminal 22, and their bases connected with each other. The base and collector of transistor Q1 are connected in common to the output 13 of the constant current source 11, so that the transistor Q1 is diode-connected. On the other hand, the collector of transistor Q2 is connected to the output 14 of the constant current source 12. When a current $I_3$ (input current) flows through the diode-connected transistor Q1, a current $I_4$ (output current) of the same magnitude as $I_3$ is caused to flow through the transistor Q2 by current-mirror effect.

The outputs 13 and 14 of the constant current sources 11 and 12 are further connected with a current sink 16 composed of NPN transistors Q3 and Q4 and a resistor R1. More specifically, the transistor Q3 has its collector connected to the constant current source 11, its emitter connected to the negative power supply terminal 22 through the emitter resistor R1, and its base connected to the base of transistor Q4. The transistor Q4 has its collector connected to the current source 12 and also to its base, and its emitter connected to the negative power supply terminal 22. Thus, the transistor Q4 is diode-connected. The transistors Q3 and Q4 are so designed as to have different emitter areas. Namely, if the transistor Q4 has an emitter area of A, the transistor Q3 with the emitter resistor R1 has an emitter area of $N \times A$ ($N > 1$), as shown in FIG. 1. Due to the existence of the current mirror 15, when a collector current $I_2$ flows through the transistor Q4 of the current sink 16, a collector current $I_1$ of the same magnitude as $I_2$ is caused to flow through the transistor Q3. As mentioned later in detail, the sink currents $I_1$ and $I_2$ are determined by the emitter area ratio N between the transistors Q3 and Q4 and the emitter resistor R1. Under the operating condition of the circuit that $I_{ref1} > I_1$ and $I_{ref2} > I_2$, therefore, the current mirror 15 absorbs surplus currents $I_{ref1} - I_1 (= I_3)$ and $I_{ref2} - I_2 (= I_4)$ so that the currents $I_1$ and $I_2$ of the given magnitude may flow through the current sink 16. An output circuit 17 having an NPN transistor Q5 is connected to the current sink 16 to provide an output current $I_0$. The transistor Q5 is connected with the transistor Q4 in current-mirror configuration. When the transistor Q5 has the same emitter area as the transistor Q4, $I_0 = I_1 = I_2$.

In the current sink 16, the base voltage $V_{B3}$ of the transistor Q3 with respect to the potential (−V) at the negative power supply terminal 22 is given by $$V_{B3} = V_{BE3} + R1 \cdot I_1$$

where $V_{BE3}$ is the base-to-emitter voltage of the transistor Q3. $V_{B3}$ is equal to the base-to-emitter voltage $V_{BE4}$ of the transistor. Thus, $$V_{BE3} = V_{BE4} = V_{BE3} + R1 \cdot I_1$$

Since $$V_{BE4} = V_T \cdot \ln \frac{I_2}{A \cdot Is}, \quad V_{BE3} = V_T \cdot \ln \frac{I_1}{N \cdot A \cdot Is}$$

(Is is reverse saturation current) and $I_1 = I_2$, follows that $$R1 \cdot I_1 = V_T \ln N$$

Thus $$I_1 = I_2 = \frac{V_T}{R1} \cdot \ln N$$

As described above, if the transistor Q5 has the same emitter area as the transistor Q4, the output current $I_0$ is equal to $I_1$ and $I_2$, so that $$I_0 = \frac{V_T}{R1} \cdot \ln N$$

Evidently, the output current $I_0$ is independent of the supply voltage and is proportional to temperature.

The above-mentioned current source circuit of this invention uses the two current sources 11 and 12 and the current mirror 15 as a circuit to supply the current sink 16 with two currents of the same magnitude which is determined by the current sink 16. The two current sources 11 and 12 may be easily designed so as to produce the reference currents $I_{ref1}$ and $I_{ref2}$ of the same magnitude even if they are formed of PNP transistors in an integrated circuit. Since the current mirror 15 to absorb surplus currents may utilize NPN transistors having a large $\beta$, the error in the ratio between the absorption currents $I_3$ and $I_4$ can considerably be reduced. That is, the current source circuit of this invention can more easily supply the current sink 16 with the sink currents $I_1$ and $I_2$ of the same magnitude as compared with the aforementioned prior art current source circuit. The output currents $I_{ref1}$ and $I_{ref2}$ of the constant current sources 11 and 12 are both increased or decreased to the same degree with a change in the supply voltage and a change in $\beta$ of the PNP transistors used due to temperature change. However, the variations of the output currents $I_{ref1}$ and $I_{ref2}$ are absorbed by the current mirror 15. Using the current sources 11 and 12, moreover, the circuit of this invention does not require any start-up circuit for actuating the circuit when the power is applied.

The output current $I_0$ substantially independent of temperature can be obtained by properly adjusting the temperature coefficient $\alpha$ of the emitter resistor R1 used in the current sink 16. The emitter resistance R1 at an absolute temperature T is given by $$R1 = R0\{1 + \alpha(T - T0)\}$$

where R0 is the resistance value at an absolute temperature T0. To make the output current $I_0 (= I_1 = I_2)$ independent of temperature at about T0 it is required that $\alpha = 1/T0$. When the temperature is 27° C. (300° K.), for example, $\alpha$ is $3{,}333 \times 10^{-6}$/°K. The temperature coefficient of a diffusion resistor produced by a conventional process for manufacturing bipolar transistors is approximately $2{,}000 \times 10^{-6}$/°K., while the temperature coefficient of a resistor produced by ion implantation is approximately $3{,}900 \times 10^{-6}$/°K. The temperature coefficient of a resistor can be adjusted according to the manufacturing process.

Figure 2A:
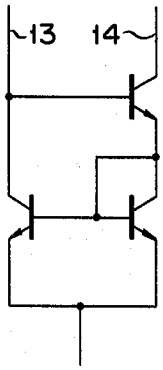
FIGS. 2A to 2D show various modifications of a current mirror 15 used in the circuit of FIG. 1.
Figure 2B:
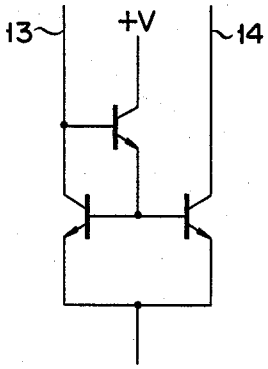
Figure 2C:
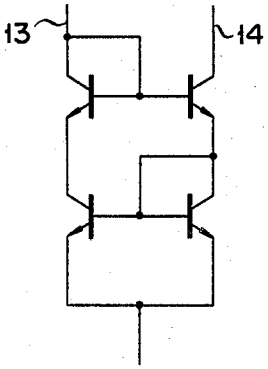
Figure 2D:
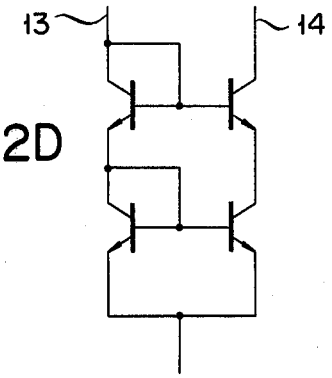
Figure 3A:
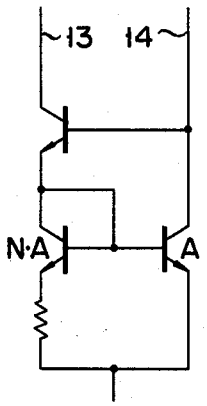
FIGS. 3A to 3H show various modifications of a current sink 16 used in the circuit of FIG. 1.
Figure 3B:
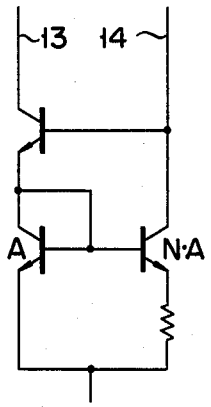
Figure 3C:
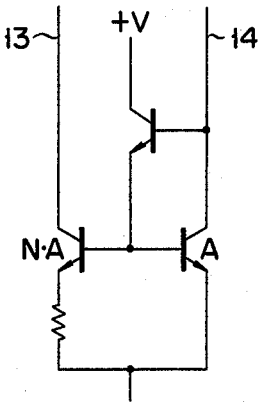
Figure 3D:
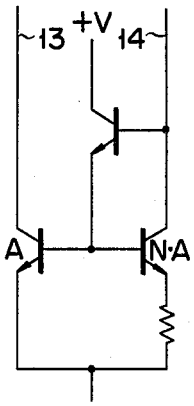
Figure 3E:
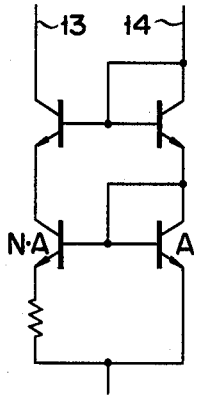
Figure 3F:
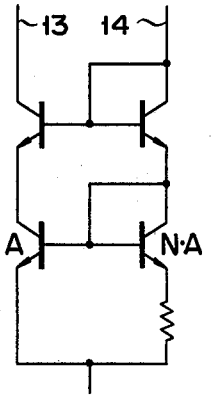
Figure 3G:
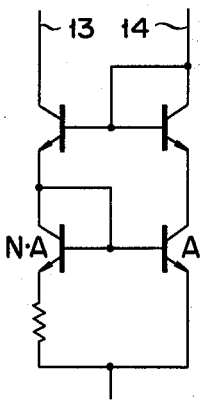
Figure 3H:
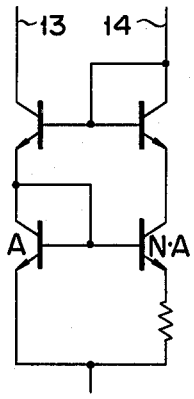

FIGS. 2A and 2D show current mirrors subject to smaller errors than that of the two-transistor current mirror of FIG. 1. The current mirrors shown in FIGS. 2A to 2D are known and called Wilson current mirror, base-compensated current mirror, improved Wilson current mirror, and cascaded current mirror, respectively. The current mirror used in this invention is not limited to those examples shown in FIG. 1 and FIGS. 2A to 2D.

FIGS. 3A to 3H show improved known current sinks which may be used instead of the two-transistor current sink 16 of FIG. 1.

Figure 4:
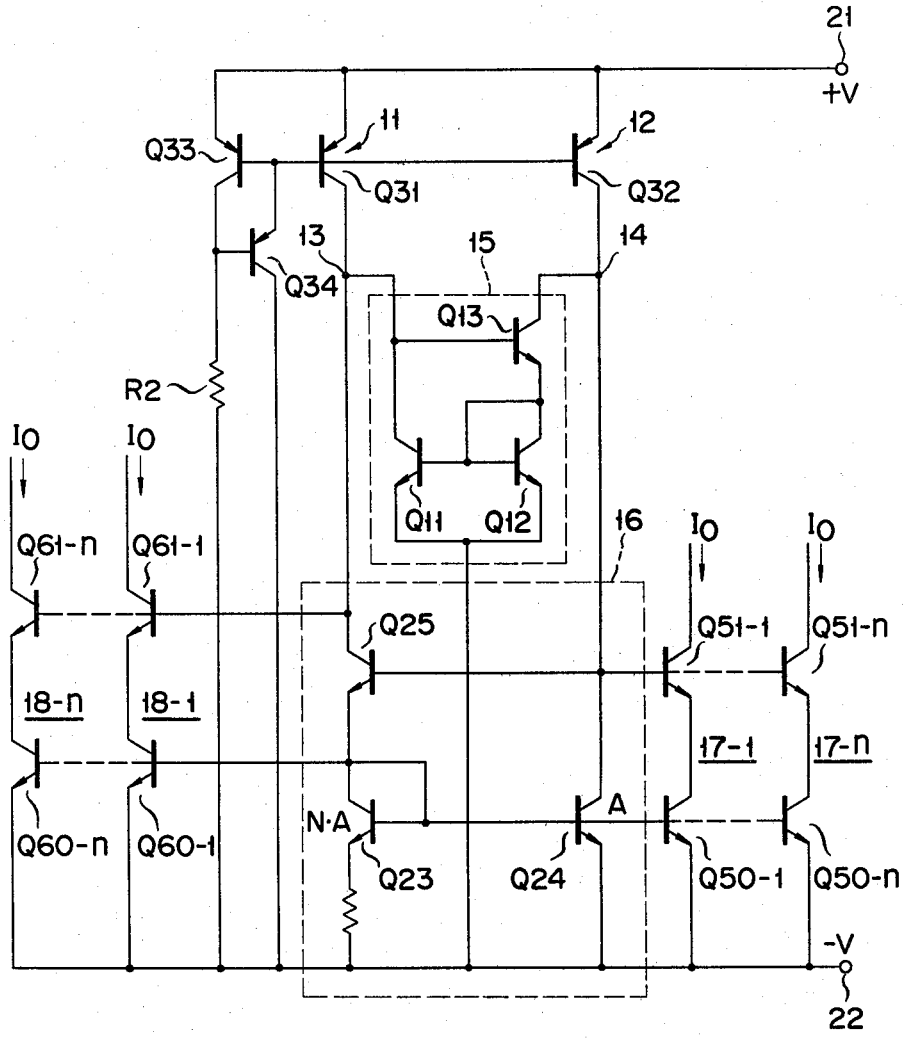
FIG. 4 shows a practical arrangement of the current source circuit of the invention.

FIG. 4 shows a practical arrangement of the current source circuit of this invention. In this arrangement, a Wilson current mirror composed of NPN transistors Q11, Q12, Q13 is used for the current mirror 15, and the circuit of FIG. 3A including NPN transistors Q23, Q24 and Q25 is used for the current sink 16. Although not necessarily required, n output circuits 17-1, . . . 17-n and 18-1, . . . 18-n are connected respectively to both sides of the current sink 16 in this arrangement. In these output circuits, pairs of NPN transistors Q50-1 and Q51-1, Q50-n and Q51-n, Q60-1 and Q61-1, and Q60-n and Q61-n are connected in series. The bases of transistors Q50-1, . . . Q50-n are connected to the base of transistor Q24, the bases of transistors Q51-1, . . . Q51-n are connected to the collector of transistor Q24, the bases of transistors Q60-1, . . . Q60-n are connected to the collector and base of transistor Q23, and the bases of transistors Q61-1, . . . Q61-n are connected to the collector of transistor Q25. Accordingly, the base voltages of transistors Q50-1, . . . Q50-n and Q60-1, . . . Q60-n with respect to the negative power supply terminal 22 are equal to the base-to-emitter voltage $V_{BE}$ of a single transistor, and the base voltages of transistors Q51-1, . . . Q51-n and Q61-1, . . . Q61-n are twice as high as $V_{BE}$. Thus, the output currents $I_0$ of the output cireuits 17-1, . . . 17-n and 18-1, . . . 18-n match well.

PNP transistors Q31 and Q32, which are used respectively for the constant current sources 11 and 12, have their bases biased in common by a bias circuit composed of transistors Q33 and Q34 and a resistor R2 and connected between the power supply terminals 21 and 22.

Figure 5A:
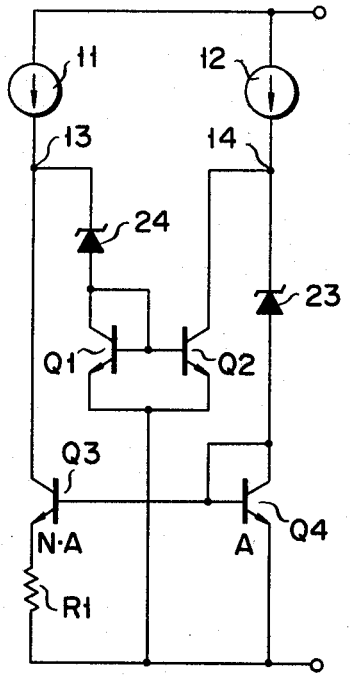
FIGS. 5A and 5B show modifications of the current source circuit of the invention.
Figure 5B:
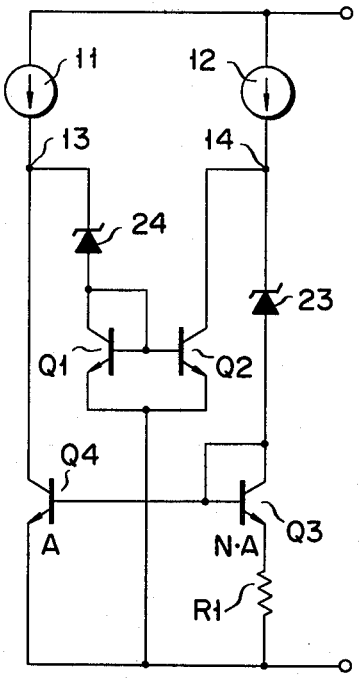

In the circuit shown in FIG. 1, the collector voltages of the transistors Q1 and Q2 in the current mirror 15 and the transistor Q3 in the current sink 16 having an emitter area of N·A are equal to the base-to-emitter voltage $V_{BE}$ of a single NPN transistor. In order to increase the collector voltages of the transistors Q2 and Q3, constant-voltage means 23 and 24 using Zener diodes may, for example, be utilized, as shown in FIG. 5A. Namely, the constant-voltage means 23 is connected between the collector of the diode-connected transistor Q4 and the output 14 of the constant current source 12, while the constant-voltage means 24 is connected between the collector of the diode-connected transistor Q1 and the output 13 of the constant current source 11. The transistors Q3 and Q4 of FIG. 5A may be replaced with each other, as shown in FIG. 5B. Alternatively, each of the constant-voltage means 23 and 24 may be formed of a plurality of series-connected Zener diodes, a plurality of series-connected diodes, or a known combination of resistors and a transistor.

What is claimed is:

1. A current source circuit comprising:

a first circuit including first and second terminals, first and second transistors of the same conductivity type having different emitter areas, bases of said first and second transistors being connected with each other and one of said first and second transistors being diode-connected, and an emitter resistor connected to an emitter of one of said first and second transistors having greater emitter area, so that first and second currents of the same magnitude depending on the emitter area ratio between said first and second transistors and the resistance value of said emitter resistor may be caused to flow into said first circuit through said first and second terminals;

an output transistor coupled to said first circuit for providing an output current; and a second circuit for allowing to provide said first and second currents at said first and second terminals of said first circuit, characterized in that said second circuit includes first and second constant current sources having outputs coupled respectively to said first and second terminals of said first circuit and providing at said outputs third and fourth currents of the same magnitude greater than that of said first and second currents, and a current mirror coupled to said outputs of said first and second current sources.

2. A current source circuit according to claim 1, wherein said current mirror includes transistors of the same conductivity type as that of said first and second transistors included in said first circuit.

3. A current source circuit according to claim 2, wherein said first and second transistors of said first circuit and said transistors of said current mirror are of NPN-type.

4. A current source circuit according to claim 1, wherein said first and second constant current sources each have a PNP-type transistor.

5. A current source circuit according to claim 1, wherein constant-voltage elements are connected respectively between said first current source and said current mirror and between said second current source and said first circuit.

* * * * *